US008425817B2

(12) United States Patent
Wybrow

(10) Patent No.: US 8,425,817 B2
(45) Date of Patent: Apr. 23, 2013

(54) MOULD ASSEMBLY

(75) Inventor: Michael N Wybrow, Nottingham (GB)

(73) Assignee: Rolls-Royce PLC, London (GB)

( * ) Notice: Subject to any disclaimer, the term of this patent is extended or adjusted under 35 U.S.C. 154(b) by 110 days.

(21) Appl. No.: 13/101,429

(22) Filed: May 5, 2011

(65) Prior Publication Data

US 2011/0272843 A1 Nov. 10, 2011

(30) Foreign Application Priority Data

May 6, 2010 (GB) ..... 1007570.3

(51) Int. Cl.
*B28B 3/00* (2006.01)
*B29C 43/02* (2006.01)

(52) U.S. Cl.
USPC ..... 264/123; 264/604; 419/68

(58) Field of Classification Search ..... None
See application file for complete search history.

(56) References Cited

U.S. PATENT DOCUMENTS 3,043,191 A * 7/1962 Lanski ..... 351/159.75
4,398,952 A * 8/1983 Drake ..... 419/18
4,704,082 A * 11/1987 Buhler et al. ..... 425/405.2
4,828,793 A 5/1989 Froes et al.
2003/0197296 A1 10/2003 Krassilnikov
2011/0027119 A1* 2/2011 Masson ..... 419/6

FOREIGN PATENT DOCUMENTS

| | | | |
|---|---|---|---|
| CN | 101450870 | A | 6/2009 |
| EP | 1 547 707 | A2 | 6/2005 |
| EP | 1 699 144 | A1 | 6/2006 |
| GB | 742963 | | 1/1956 |
| GB | 1137642 | | 12/1968 |
| GB | 2 208 389 | A | 3/1989 |
| GB | 1007570 | | 8/2010 |
| WO | WO 2009/083571 | A1 | 7/2009 |

OTHER PUBLICATIONS

Search Report issued in European Patent Application No. 11164962.0 dated Sep. 26, 2011.
British Search Report issued in British Application No. GB1007570.3 dated Aug. 31, 2010.

* cited by examiner

*Primary Examiner* — Mary F Theisen
(74) *Attorney, Agent, or Firm* — Oliff & Berridge, PLC

(57) ABSTRACT

A mold assembly (100) for forming an object, the mold assembly comprising: a first mold portion (110) comprising an internal surface (112), an external surface (114) and an opening (116) leading from the internal surface to the external surface; and a second mold portion (120) positionable with respect to the opening (116) to cover the opening; wherein the first and second mold portions define an interior (130) for receiving a material to be molded into the object; and wherein the second mold portion comprises a surface (122) adapted to face the interior of the mold assembly and form a feature on the object.

5 Claims, 3 Drawing Sheets

(a)

(b)

MOULD ASSEMBLY

This invention relates to a mould assembly and particularly but not exclusively relates to a mould assembly for hot isostatic pressing applications.

BACKGROUND

Objects or components may be formed by forging. By way of example, FIG. 1(*a*) shows a gas turbine combustion chamber casing 10, which may be manufactured from a large single piece forging 20. (FIG. 1 shows sections through the combustion chamber casing 10, which is substantially tubular with a longitudinal axis 30.) The design of such casings 10 dictates the envelope of the forging 20. The forging may then be machined to provide the finished product. However, it is typical that approximately 90% of the purchased material has to be removed to produce the finished component. Consequently, the current method of manufacture of gas turbine combustion chamber casings results in a material 'fly to buy' ratio of approximately 10%. Whilst this excess material may be recycled, it does not command the same scrap price as the purchase price. This incurs cost in both cycle time to remove the material and consumables.

Alternatively, Hot Isostatic Pressing (HIP), for example powder HIP, may be used as a method of manufacture, as it may have a much better 'fly to buy' ratio. As shown in FIG. 1(*b*), powder HIP requires a tool 40, e.g. a mould, to be manufactured from a large forging. The tool 40 may comprise a plurality of portions 40*a-c*, which may be separated to remove the casing 10. However, any external features on the object or component being moulded need to be machined on the inside of the mould, which causes access problems for both machining and inspection. Furthermore, the machining of internal features deep inside a mould requires the use of long tooling and right angled heads that are not as rigid as standard tooling. This can result in tool 'push off' and tool chatter resulting in non-conforming features on the mould. As a result, machining with such tools is generally quite slow and expensive. In addition, if any of the internal features are machined incorrectly then the mould could be scrap.

The present invention therefore seeks to address these issues.

STATEMENTS OF INVENTION

According to a first aspect of the present disclosure, there is provided a method of forming an object, the method comprising: providing a mould assembly comprising first and second mould portions defining an interior for receiving a particulate material to be moulded into the object, wherein the first mould portion comprises an internal surface, an external surface and an opening leading from the internal surface to the external surface, and wherein the second mould portion comprises a surface adapted to face the interior of the mould assembly and form a feature on the object; filling the mould assembly with the particulate material; positioning the second mould portion with respect to the first mould portion to cover the opening; forming the object in the mould assembly by applying heat and pressure to the mould assembly; and simultaneously forming the object and the feature on the object.

The method may further comprise securing the second mould portion to the first mould portion. For example, the second mould portion may be securable to the first mould portion by virtue of a freeze fit, a press fit, mechanical attachment (bolts, studs, screws, etc.), adhesives, fusion welding techniques or any other attachment means. The mould assembly may comprise one or more openings and one or more second mould portions.

The method may further comprise removing the mould assembly from the object.

The step of providing the mould assembly comprises the step of providing the first mould portion having an inner wall and an outer wall defining an annular chamber between them.

The opening may be formed by drilling through either the inner or outer wall.

The mould assembly may comprise a plurality of openings and a respective second mould portion for each opening.

The second mould portion may comprise a protruding portion. The protruding portion may be adapted to engage the opening.

The second mould portion may comprise a feature portion. The feature portion may be adapted to form a corresponding feature on the object. The first and second mould portions may be for use in a Hot Isostatic Pressing process, for example a powder Hot Isostatic Pressing process.

A turbomachine may comprise the aforementioned object. A gas turbine may comprise the aforementioned object. The object may comprise a casing, for example a combustion chamber casing.

The second mould portion may be secured to the first mould portion. The mould assembly may be removed from the object. Hot Isostatic Pressing (e.g. powder Hot Isostatic Pressing) of the material may be used to form the object.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION

Figure 1:
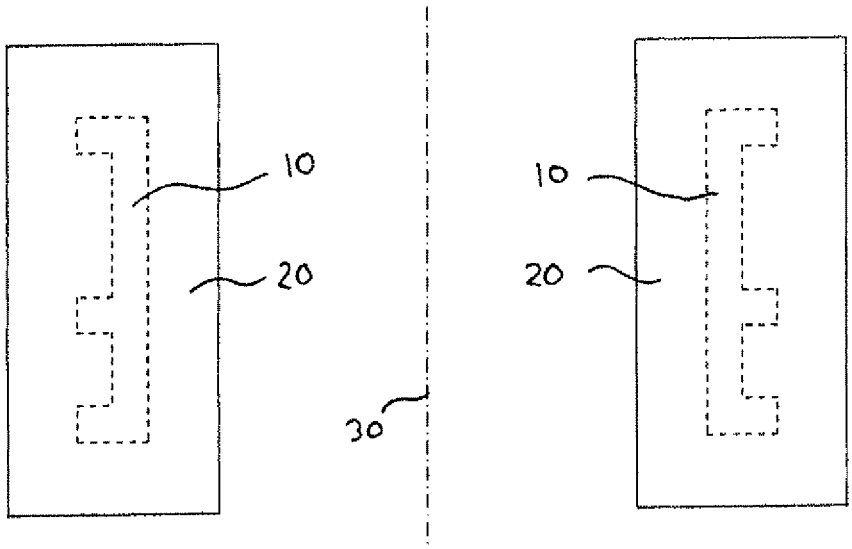
FIGS. 1(*a*) and 1(*b*) show prior art arrangements for forming an object.
Figure 1:
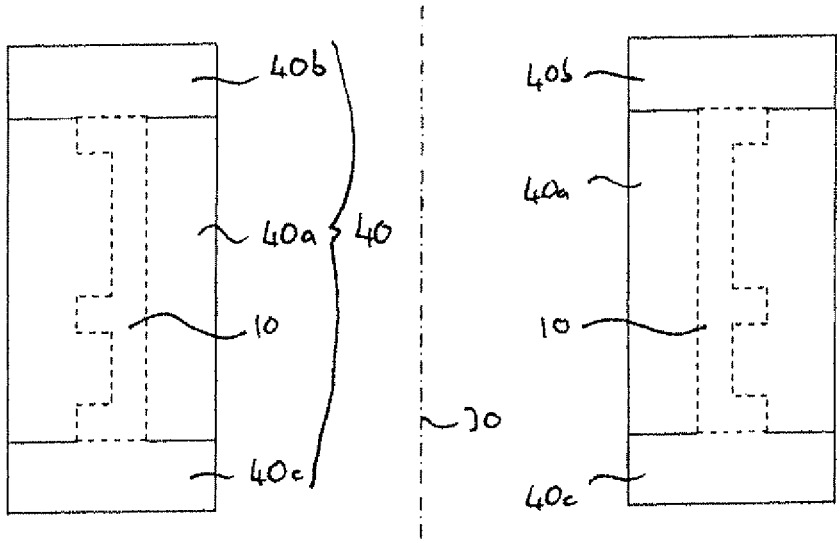
Figure 2:
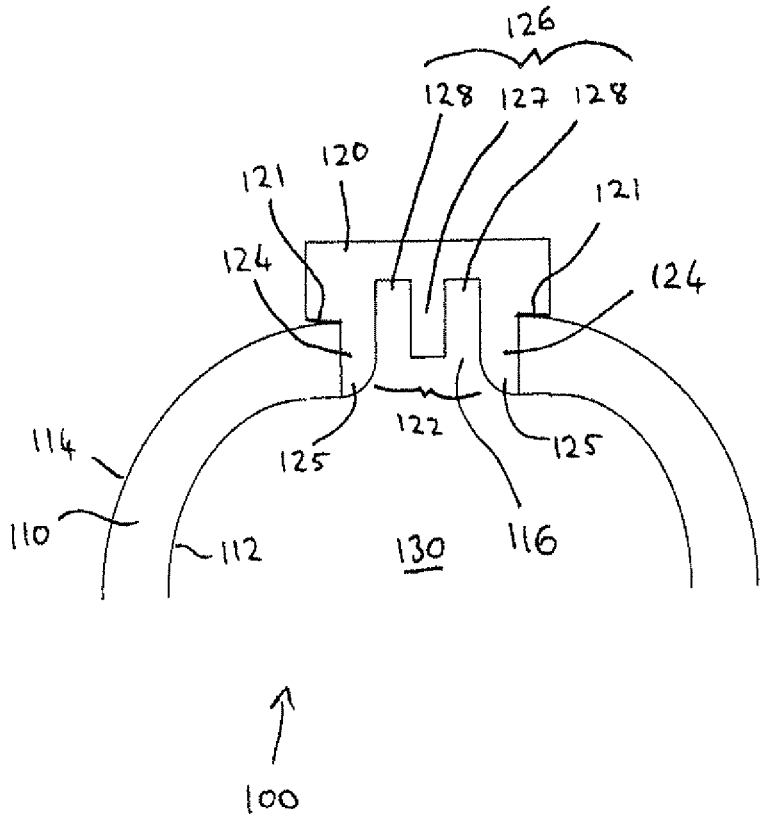
FIG. 2 shows a partial sectional side view of a mould for a combustion chamber casing according to an example of the present disclosure.

With reference to FIG. 2, a mould assembly 100 for forming an object, e.g. a component or article, according to an example of the present disclosure, may comprise a first mould portion 110 and a second mould portion 120. The first and second mould portions may define an interior 130 for receiving a material to be moulded into the object. The moulded object may be a component. In particular, the object may be a component for a gas turbine engine, for example a casing section. The object may be a casing section for a combustion chamber.

The first mould portion 110 may comprise an internal surface 112 and an external surface 114. The internal surface 112 may correspond in shape to the desired shape for the object to be moulded. The first mould portion 110 may further comprise an opening 116, e.g. bore or hole, leading from the internal surface 112 to the external surface 114.

The second mould portion 120 may be positionable with respect to the opening 116 to cover (e.g. seal, close or conceal) the opening. For example, as shown in FIG. 2, the second mould portion may at least partially be inserted into the opening 116 of the first mould portion 110. The second mould portion 120 may be secured to the first mould portion 110. In particular, the second mould portion 120 may be secured to the exterior surface 114 of the first mould portion 110. For example, the second mould portion may be secured to the first mould portion by virtue of one or more of a freeze fit, a press fit, mechanical attachment (bolts, studs, screws, etc.), adhesives, fusion welding techniques or any other attachment means. A fluid tight seal may be provided between the first and second mould portions.

In the example shown in FIG. 2, the second mould portion 120 may comprise a protruding portion 124. The protruding portion 124 may be adapted to engage the opening 116, for example so that the second mould portion 120 is insertable into the opening 116 of the first mould portion 110. The protruding portion 124 may be disposed about the perimeter of the opening 116, e.g. to provide a tight fit against the opening. The second mould portion 120 may therefore act as a plug or bung blocking the opening 116. The second mould portion 120 may be further secured to the first mould portion 110 by any of the above-mentioned attachment means.

The second mould portion 120 may comprise a surface 122 adapted to face the interior of the mould assembly 100 and form a feature e.g. a boss, on the object. The feature formed on the object may correspond in shape to the surface 122 of the second mould portion 120. In particular, the second mould portion 120 may comprise a feature portion 126. The feature portion 126 may be adapted to form the corresponding feature on the object. In the example shown in FIG. 2, the feature portion 126 may comprise a recess 128 between sides of the protruding portion 124 and a protrusion 127 set back in the surface 122. Accordingly, the protrusion 127 and the recess 128 may form a corresponding recess and protrusion in the object to be formed.

The protruding portion 124 of the second mould portion 120 may be blended, e.g. rounded, at an end 125 of the protruding portion which may be adjacent to the internal surface 112 of the first mould portion 110. A smooth transition between the internal surface 112 of the first mould portion 110 and the surface 122 of the second mould portion 120 may thus be provided.

The second mould portion 120 may comprise an abutment surface 121. The abutment surface 121 may abut the external surface 114 of the first mould portion 110 adjacent to the opening 116. The abutment surface 121 may thus limit movement of the second mould portion 120 with respect to the opening 116. The protruding portion 124 and abutment surface 121 may be arranged such that the end 125 of the protruding portion lines up with the internal surface 112 of the first mould portion 110.

The opening 116 may comprise a slot, e.g. an elongate slot, and the second mould portion 120 may be elongate to engage the slot. The first mould portion may be substantially tubular and the opening 116 and/or second mould portion 120 may be orientated in a longitudinal, circumferential or any other direction.

In an alternative embodiment (not shown), the opening may comprise a blind bore. For example, the blind bore may be provided on the internal surface of the first mould portion. At least a part of the second mould portion may fit inside the internal blind bore.

Figure 3:
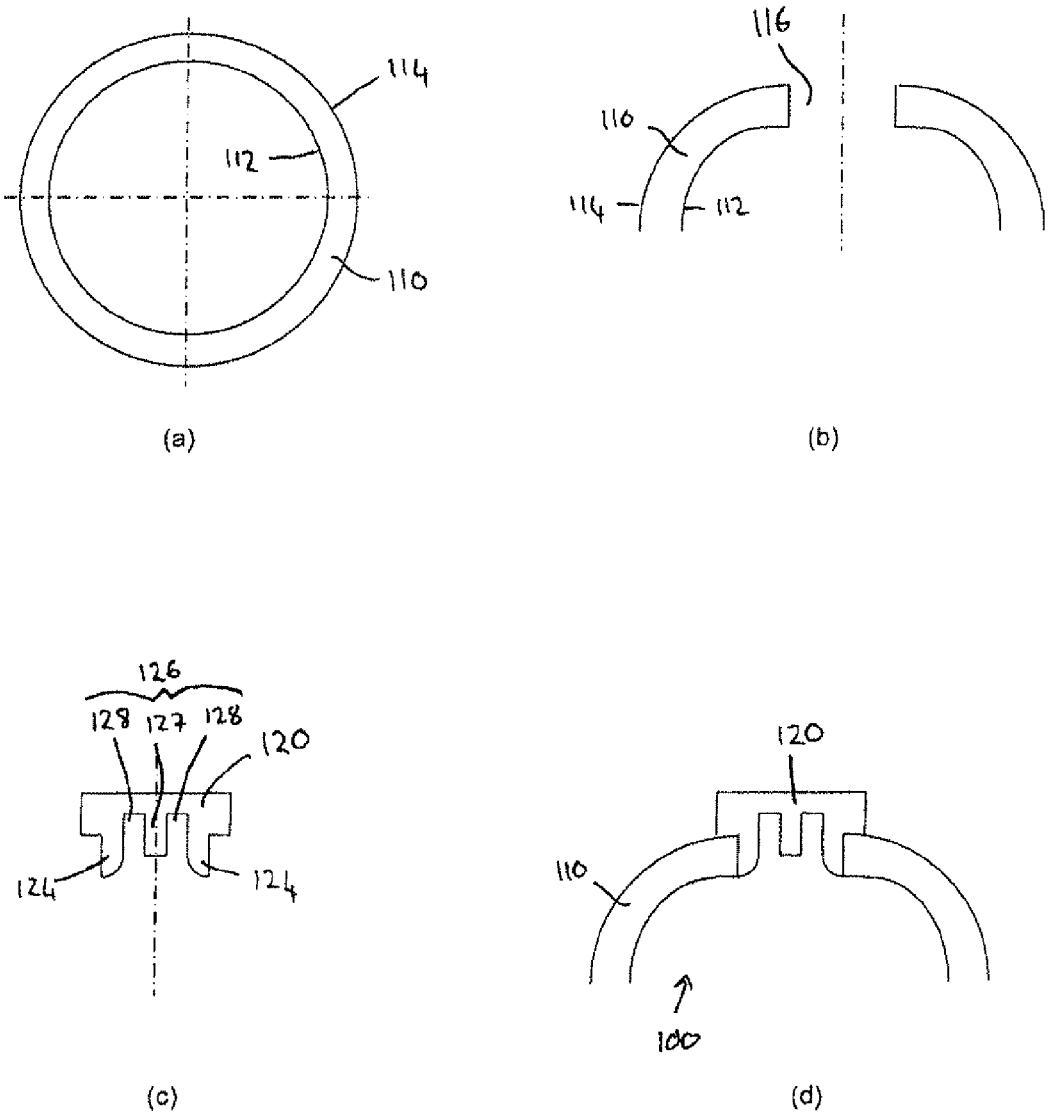
FIGS. 3(*a*)-(*d*) show a process by which a mould according to an example of the present disclosure may be formed.

With reference to FIG. 3, the mould assembly 100 may be formed in one or more stages. As shown in FIG. 3(*a*), the first mould portion 110 may be formed by machining the internal surface 112 from a workpiece. The first mould portion 110, and hence the object to be formed, may be substantially tubular. Referring to FIG. 3(*b*), the opening 116 may then be formed by machining, e.g. drilling or boring, the opening 116 into the first mould portion 110. The opening 116 may be machined from either the internal or external surface 112, 114 of the first mould portion 110. The opening 116 may be positioned where a feature, e.g. a boss, is required on the finished object.

The second mould portion 120, shown in FIG. 3(*c*), may be machined separately from the first mould portion 110. The second mould portion 120 may have the required localised finished form machined onto it more easily than machining the internal surface 112 of the first mould portion 110. The protruding portion 124 and/or feature portion 126 may also be machined into the surface 122 of the second mould portion 120. Referring to FIG. 3(*d*), the second mould portion 120 may be placed over the opening 116, and in the example shown, fitted into the opening 116. The opening 116 may thus be sealed such that any material placed in the mould assembly 100 may not leak through the opening 116 from the interior 130. The second mould portion 120 may be positioned with respect to the first mould portion 110 to achieve the correct orientation of the feature to be formed on the object.

The present disclosure may provide an improvement to the powder HIP method of manufacture, by using inserts in moulds or tools to negate the requirement to complete any complex internal machining. The present disclosure allows complex external casing features to be produced using the powder HIP method. It removes the requirement for complex, difficult to access internal features and negates the requirement for long flimsy arbours when machining at depth in components. The complex forms can be more easily and accurately machined into the second mould portion.

Furthermore, any errors during the manufacture of the second mould portion will only scrap the second mould portion and not the rest of the mould assembly. A further advantage is that the openings, which are machined into the first mould portion may all be manufactured from the outside making the manufacturing of the tool much easier.

The present disclosure may be applied to any moulding or casting method for example, Hot Isostatic Pressing and in particular powder Hot Isostatic Pressing.

The invention claimed is:

1. A method of forming an object, the method comprising:

providing a mould assembly comprising first and second mould portions defining an interior for receiving a particulate material to be moulded into the object, wherein the first mould portion comprises an internal surface, an external surface and an opening leading from the internal surface to the external surface, and wherein the second mould portion comprises a surface adapted to face the interior of the mould assembly and form a feature on the object;

filling the mould assembly with the particulate material;

positioning the second mould portion with respect to the first mould portion to cover the opening;

forming the object in the mould assembly by applying heat and pressure to the mould assembly; and simultaneously forming the object and the feature on the object, wherein the mould assembly comprises a plurality of openings and a respective second mould portion for each opening.

2. The method of forming an object as claimed in claim 1, wherein the method further comprises:

securing the second mould portion to the first mould portion.

3. The method of forming an object as claimed in claim 1, wherein the method further comprises:

removing the mould assembly from the object.

4. The method of forming an object as claimed in claim 1, wherein the step of providing the mould assembly comprises the step of providing the first mould portion having an inner wall and an outer wall defining an annular chamber between them.

5. The method of forming an object as claimed in claim 1, wherein the opening is formed by drilling through either the inner or outer wall.

* * * * *